US006510231B2

(12) United States Patent
Barnert

(10) Patent No.: US 6,510,231 B2
(45) Date of Patent: Jan. 21, 2003

(54) ELECTROACOUSTIC TRANSDUCER

(75) Inventor: Richard Barnert, Wiener Neustadt (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 09/770,511

(22) Filed: Jan. 25, 2001

(65) Prior Publication Data

US 2001/0046306 A1 Nov. 29, 2001

(30) Foreign Application Priority Data

Jan. 27, 2000 (AT) ..... 122/2000

(51) Int. Cl.[7] ..... H04R 25/00
(52) U.S. Cl. ..... 381/191; 381/174
(58) Field of Search ..... 381/174, 191, 381/113, 116, 190; 367/170, 181

(56) References Cited

U.S. PATENT DOCUMENTS 3,892,927 A * 7/1975 Lindenberg ..... 381/191
3,930,128 A * 12/1975 Fidi et al. ..... 381/191
4,796,725 A 1/1989 Katayama

FOREIGN PATENT DOCUMENTS

| | | | | |
|---|---|---|---|---|
| EP | 0556792 | * | 8/1993 | ..... 381/191 |
| GB | 0571778 | * | 9/1945 | ..... 381/174 |
| SU | 1784111 | | 12/1992 | |
| WO | 8200745 | | 3/1982 | |

* cited by examiner

*Primary Examiner*—Huyen Le
(74) *Attorney, Agent, or Firm*—Friedrich Kueffner

(57) ABSTRACT

An electroacoustic transducer based on the capacitor principle includes an essentially rigid electrode and a flexible electrode constructed as a diaphragm. In the central areas of the electrodes the distance between the diaphragm and the rigid electrode is smaller than in the edge areas thereof. The transducer may include a resonator attachment. The diaphragm is deformed into a cone shape or truncated cone shape. The rigid electrode has in the central area thereof an at least essentially circular-cylindrical projection, wherein the diaphragm rests against this projection, for example by a nipple attached to the resonator attachment.

12 Claims, 1 Drawing Sheet

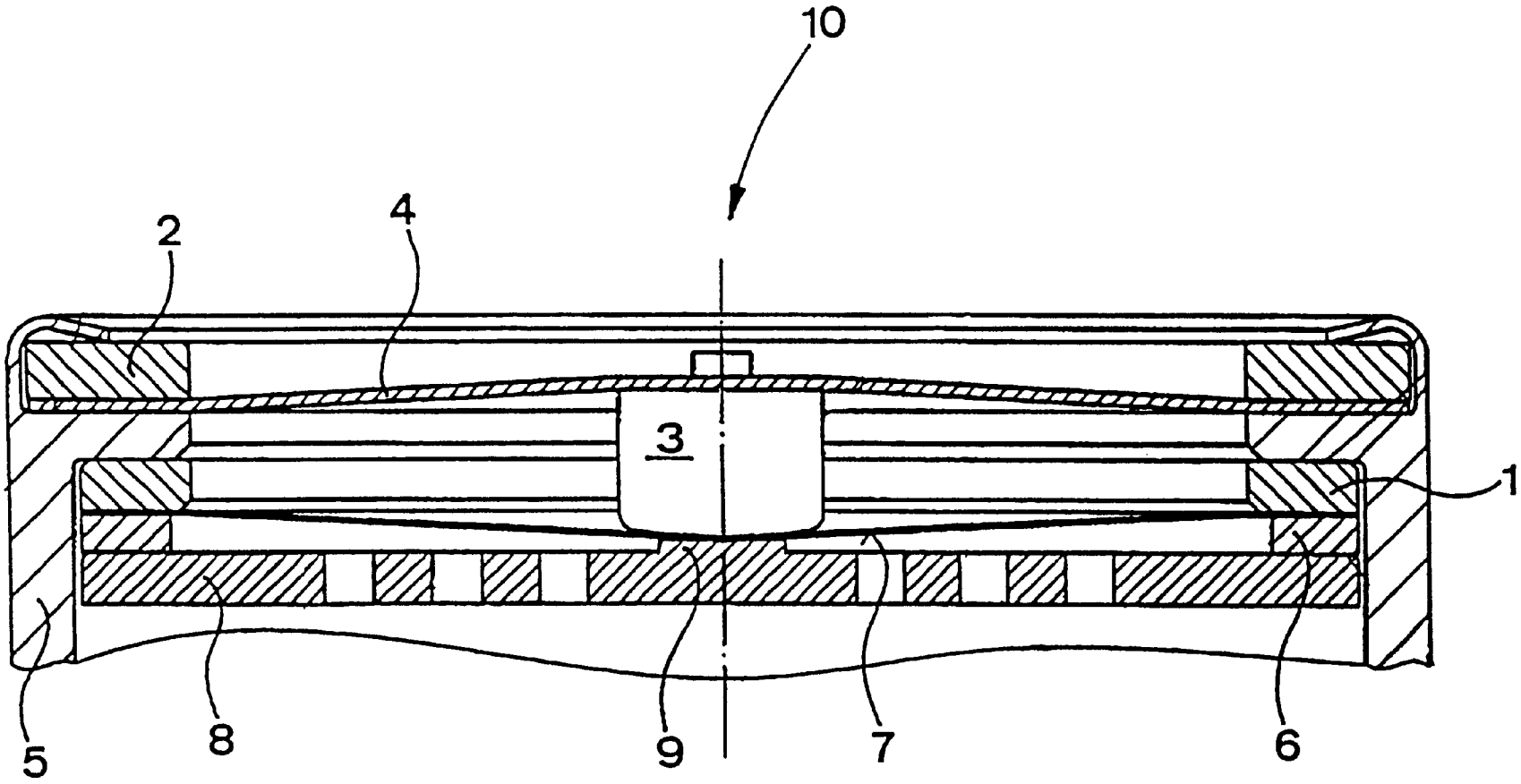
10
2
4
3
1
9
7
6
8
5

ELECTROACOUSTIC TRANSDUCER

BACKGROUND OF THE INVENTION

1. Field of the Invention

The present invention relates to an electroacoustic transducer based on the capacitor principle. The transducer includes an essentially rigid electrode and a flexible electrode constructed as a diaphragm, wherein in the central areas of the electrodes the distance between the diaphragm and the rigid electrode is smaller than in the border areas thereof. The transducer may also include a resonator attachment.

2. Description of the Related Art

A transducer of the above-described type is disclosed in W082/00745 A1. In this transducer, the rigid electrode has a convex shape on its side facing the diaphragm, so that the changing distance between the diaphragm and the rigid electrode is obtained from radius to radius. The rigid electrode is held only by individual hooks in the upper area of an insulating housing, wherein air can flow between the hooks into a chamber formed behind the fixed diaphragm, so that the characteristics, and especially the pickup pattern, of the microphone can be adjusted to the desired values.

Another transducer with a diaphragm and a rigid electrode is disclosed in U.S. Pat. No. 4,796,725 A. In order to be able to operate in the ultrasonic range, the diaphragm is pulled onto the convexly constructed electrode and is raised a small distance from the electrode by applying a direct voltage with superimposed alternating voltage, on the one hand, and is caused to vibrate with correspondingly high-frequency vibrations, on the other hand. Aside from the vibration modes occurring as a result, the diaphragm remains always at the same distance from the electrode or has a slightly greater distance in the center as compared to the border where the diaphragm is mounted.

A completely different transducer is constructed as a hydrophone and is disclosed in SU 1 784 111 A3. In this transducer, a rigid electrode and an electrode capable of oscillation are used, wherein the electrode capable of oscillation is composed of a dome-shaped Teflon plate whose border rests freely outside of the rigid electrode against a housing projection and whose apex rests against a screw cap, wherein by turning the screw cap the height of the Teflon dome can be changed by elastic deformation and the radiation characteristic of the hydrophone can be adjusted to the desired values.

In general, transducers based on the capacitor principle, to which the present invention relates, are composed of a rigid electrode and a flexible electrode which is held tensioned in front of and at a slight distance from the rigid electrode, wherein, when the transducer is used as a microphone, the flexible electrode is oscillated by the impinging sound waves, so that the capacity of the capacitor formed by the two electrodes is changed which, appropriately converted and amplified, completes the transducer.

The flexible electrode may be of synthetic material and be coated with an electrically conducting material, possibly gold, and the rigid electrode, depending on the type of charge application, may be of a conductive or insulating material with applied charge carriers or an electrically conductive coating or layers. The contacting can be effected in various ways and is not part of the invention.

In transducers of this type, it is possible to either apply an external voltage (true capacitor principle) or to apply charge carriers permanently on one of the electrodes (electret principle). The sensitivity of such a transducer can be influenced by changing the distance between the electrodes and/or by changing the applied voltage (or by changing the charge in the case of the electret principle). An increase of the voltage or mounting the electrodes closer together in their positions of rest lead to an increase of the sensitivity which, when used as a microphone, is to be defined as the ratio of the output voltage to the sound pressure.

The operation of these transducers is satisfactory and, compared to electrodynamic transducers in which the diaphragm is provided with a coil, these transducers have several advantages: because of the extremely small mass of the diaphragm which forms the flexible electrode, the transducers can also convert very high-frequency sound waves.

However, these transducers also have disadvantages which are primarily due to the limits of the sensitivity or the voltage, or of the charge which can be applied in the case of the electret principle, and which are due to the requirement to maintain a minimum distance between the electrodes, because the charge induces an attracting effect between the electrodes which may have the result that, particularly in the case of greater movements of the diaphragm, the diaphragm is moved so closely to the rigid electrode that the attracting forces exceed the elastic restoring forces and the diaphragm makes permanent contact with the rigid electrode over a small or large area thereof, which means, of course, that the oscillating behavior in the remaining areas becomes completely unpredictable and the transducer characteristics become undefined and useless.

Since the increase of the applied voltage has a very positive influence on the transducer characteristics because the sensitivity is increased or the output signal with otherwise the same transducer parameters becomes stronger, it is now being attempted to increase the applied voltage as much as reasonably possible, or to reduce the distance between the parallel electrodes, which, of course, has the result that there are frequently problems with the diaphragm adhering to the other electrode.

The frequency pattern of such transducers, particularly of such electret microphones, is substantially influenced by a resonator attachment and the edge of this resonator attachment. The resonator attachment extends parallel to the two electrodes and is generally composed of a foil which has a significantly greater thickness than the diaphragm and is provided with openings in order to facilitate the passage of the sound and simultaneously to influence the sound. This resonator attachment is held by a ring in the capsule of the transducer (transducer housing), wherein the height of the ring also influences the transducer characteristics.

SUMMARY OF THE INVENTION

Therefore, it is the primary object of the present invention to provide a transducer of the above-described type in which the problems discussed above are eliminated.

In accordance with the present invention, in a transducer having the conventional, approximately circular shape of the electrodes, the diaphragm is deformed into a cone shape or truncated cone shape.

This configuration according to the present invention has been found in experiments to significantly increase the capsule sensitivity of the transducer. The transducer according to the present invention also surprisingly solves the problems discussed above. The rigid electrode may be flat or curved and the diaphragm may be elastically deformed or partially plastically deformed.

In accordance with a further development of the invention, an essentially circular projection is formed in the center area of the rigid electrode. The projection may be integrally formed with the rigid electrode. The flexible electrode rests against the circular projection. For example, the flexible electrode is glued to the projection. In the case of an electret microphone, this center area is preferably free of charge carriers.

In accordance with another development of the invention, an essentially circular projection is formed at least in the center area of the resonator attachment, wherein the circular projection is directed toward the diaphragm. The circular projection may be formed integrally with the resonator attachment. Also in this case the diaphragm may be glued to the projection in order to ensure the diaphragm is not pulled toward the rigid electrode and adheres to the rigid electrode under the influence of the opposite charges.

As a result of the measure of mounting the electrodes closer together in the central area, it is in fact unexpectedly possible to significantly increase the capsule sensitivity, without having the undesired effect of the flexible electrode adhering to the rigid electrode. It has additionally completely surprisingly be found that an increase of the characteristic in the bass range occurs, so that the linearity of the transducer reaches further into the bass range as is the case in transducers according to the prior art.

In accordance with a first embodiment of the invention, the flexible electrode or diaphragm is pressed against the projection, preferably by means of a nipple, which is mounted or provided in the center of the resonator attachment and presses the flexible electrode against the projection while elastically deforming the resonator attachment.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single Figure of the drawing is a sectional view of an embodiment of the transducer according to the present invention.

DESCRIPTION OF THE PREFERRED EMBODIMENTS

In the illustrated embodiment, an electroacoustic transducer 10 based on the capacitor principle includes a housing 5 in which are mounted a rigid electrode 8 and a coated pretensioned diaphragm 7 serving as a counter electrode, wherein the electrode 8 and the diaphragm 7 are spaced apart from each other by a spacer ring 6 and the diaphragm 7 is held by means of a diaphragm ring 1.

Mounted on the front side of the diaphragm 7 is a resonator attachment 4 which is held by a support ring 2 and, in the illustrated embodiment, is secured by bending the rim of the housing 5.

In accordance with the present invention, the rigid electrode 8 has in its central area an essentially circular-cylindrical projection 9, wherein the diaphragm, 7 is pressed against the projection 9 by means of a nipple 3. The contact pressure results from the elastic deformation of the resonator attachment 4, wherein the nipple 3 is attached to the resonator attachment 4 by inserting a projection into a central opening of the resonator attachment.

When the spacer ring 6 between the two electrodes has a conventional height of about 60 $\mu$m, it is completely sufficient to provide the circular-cylindrical projection 9 with a height of about 20 $\mu$m in order to be able to increase the sensitivity of the capsule by 3 dB (decibels), while still being able to reliably prevent the diaphragm 7 from adhering to the rigid electrode 8.

If the electroacoustic transducer operates according to the electret principle and the rigid electrode carries the charges, the circular-cylindrical projection 9 preferably remains uncharged, however, the charge carriers extend immediately up to the projection. If the diaphragm 7 carries the charges, it is advantageous to leave that portion of the diaphragm which rests against the projection 9 without charges.

The Figure also shows that the rigid electrode 8 has openings; as a result of these openings, the diaphragm 7 does not have to oscillate against an air cushion; the perforations in the resonator attachment are not illustrated. Since these are elements which are known in the art, it does not appear to be necessary to further explain these details.

All materials used in accordance with the prior art when manufacturing electroacoustic transducers according to the capacitor principle can be used as materials of the transducer according to the present invention; the nipple 3 may be of synthetic material, for example, ABS (acrylonitrile butadiene styrene copolymers). Contacting of the electrodes is not influenced by the invention and, therefore, does not require further explanation.

The dimensions and relationships shown in the schematic Figure of the drawing are not to be considered to be to scale; however, it has been found to be advantageous if the nipple 3 has a substantially greater dimension than the projection 9 and if its outer edges are significantly rounded off; preferably, the diameter of the nipple 3 is at least 10% greater than the diameter of the projection 9; it is especially preferred if the nipple 3 has a diameter which is greater by 20% than that of the projection 9. The radius of the rounded edges of the nipple 3 is preferably at least 1 mm; the projection 9 does not have to be rounded off. However, the projection 9 should have a cylindrical or almost cylindrical outer surface in order to ensure that the diaphragm 7 has a relatively great distance from the rigid electrode 8 already slightly radially outside of the end face of the projection 9. The typical diameter of the projection 9 is 5–15% of the free diameter of the electrode.

The invention is not limited to the illustrated embodiment. Rather, various modifications are possible. For example, the spacer member between the diaphragm 7 and the resonator attachment 4 may be constructed differently, for example, annularly, and may be attached differently, for example, by gluing. The diaphragm may also be glued directly to the projection 9 or may be welded thereto by ultrasonic welding. It is possible in this connection to apply a reinforcement plate or a reinforcement ring onto the side of the diaphragm facing away from the projection. The electrodes and the resonator attachment will usually be constructed essentially circular, however, deviations from the circular shape are also conceivable in case of special applications.

It is possible to increase or also decrease the deviation from the parallel arrangements of the electrodes by an appropriate configuration of the surface of the rigid electrode directed toward the diaphragm in order to further influence the transducer characteristic and adapt it to the respective requirements. It is further possible to deform the diaphragm in such a way that it is deformed at least partially plastically, so that the transducer characteristic can also be influenced.

While specific embodiments of the invention have been shown and described in detail to illustrate the inventive principles, it will be understood that the invention may be embodied otherwise without departing from such principles.

I claim:

1. An electroacoustic transducer based on the capacitor principle comprising an essentially rigid electrode and a flexible electrode comprised of a diaphragm mounted at a distance from the rigid electrode, wherein the electrodes each have a central area and an edge area, wherein the distance between the diaphragm and the rigid electrode is smaller in the central areas of the electrodes than in the edge areas thereof, and wherein the diaphragm is pretensioned into a cone shape or truncated cone shape.

2. The transducer according to claim 1, further comprising a resonator attachment.

3. The transducer according to claim 1, wherein the rigid electrode has in the central area thereof an at least essentially circular cylindrical projection, wherein the diaphragm is in contact with the projection.

4. The transducer according to claim 2, further comprising a spacer member mounted between the resonator attachment and the diaphragm.

5. The transducer according to claim 4, wherein the spacer member is comprised of a nipple attached to the resonator attachment.

6. The transducer according to claim 3, wherein the diaphragm is attached to the projection.

7. The transducer according to claim 3, wherein the diaphragm is glued to the projection.

8. The transducer according to claim 3, wherein the diaphragm comprises a reinforcement plate or ring on a side facing away from the projection.

9. The transducer according to claim 2, wherein the resonator attachment has on a side facing the diaphragm an increased thickness portion serving as spacer member, wherein the diaphragm rests against the increased thickness portion.

10. The transducer according to claim 9, wherein the diaphragm is glued to the increased thickness portion.

11. The transducer according to claim 1 operating according to the electret principle, wherein one of the electrodes is provided with charge carriers and the central area thereof is free of charge carriers.

12. The transducer according to claim 1, wherein the diaphragm is deformed elastically.

* * * * *